US006392508B1

(12) United States Patent
Damphousse et al.

(10) Patent No.: US 6,392,508 B1
(45) Date of Patent: May 21, 2002

(54) TUNEABLE WAVEGUIDE FILTER AND METHOD OF DESIGN THEREOF

(75) Inventors: Simon Jacques Damphousse, Nepean; Steve A. Beaudin, Ottawa, both of (CA)

(73) Assignee: Nortel Networks Limited, St. Laurent ( * ) Notice: Subject to any disclaimer, the term of this patent is extended or adjusted under 35 U.S.C. 154(b) by 0 days.

(21) Appl. No.: 09/536,598

(22) Filed: Mar. 28, 2000

(51) Int. Cl.[7] ..... H01P 1/207; H01P 1/208
(52) U.S. Cl. ..... 333/209; 333/235; 333/212
(58) Field of Search ..... 333/209, 208, 333/212, 235, 231

(56) References Cited

U.S. PATENT DOCUMENTS 2,563,412 A * 9/1951 Nergaard ..... 331/97
3,825,863 A * 7/1974 Meier ..... 333/248 X
3,914,713 A * 10/1975 Konishi et al. ..... 333/21 R
4,761,625 A * 8/1988 Sharma ..... 333/209
4,800,349 A * 1/1989 Gurcan et al. ..... 333/208

* cited by examiner

*Primary Examiner*—Robert Pascal
*Assistant Examiner*—Stephen E. Jones
(74) *Attorney, Agent, or Firm*—Dennis R. Haszko; Smart & Biggar

(57) ABSTRACT

A tuneable E-plane waveguide filter is presented. Tuning is achieved using sliders inserted into the cavities of the insert of the waveguide filter. The sliders are inserted through gaps or notches in the insert, or through notches in the waveguide housing. The positions of the sliders is adjusted to fine-tune the frequency response of the waveguide filter, overcoming limits on narrow relative bandpasses imposed by manufacturing tolerances. When a desired frequency response is achieved, the sliders are fixed in position. Assembly and tuning is less expensive and less complex than tuneable H-plane waveguide filters.

33 Claims, 4 Drawing Sheets

TUNEABLE WAVEGUIDE FILTER AND METHOD OF DESIGN THEREOF

FIELD OF THE INVENTION

This invention relates to waveguide filters, and more particularly to tuneable E-plane waveguide filters.

BACKGROUND OF THE INVENTION

E-plane waveguide filters consist of a waveguide, formed by two halves of a rectangular parallelepiped housing, and an insert. The insert is a relatively thin sheet of electrically conductive material, typically copper, of uniform thickness and etched or stamped with patterns. The insert is placed between the two halves of the housing so that when the waveguide is assembled the insert lies along the longitudinal axis of the waveguide and is oriented in a plane parallel to the short dimension of the cross-section of the waveguide. The patterns in the insert consist of spacings, or cavities, separated by remaining portions of the insert called fins, all of which run the full interior height of the waveguide. The cavities have resonant frequencies defined by their geometry and the fins have inverting properties defined by their geometry. The frequency response of the filter depends on the lengths of the cavities and fins, on the thickness of the insert, and on the dimensions of the waveguide housing.

Manufacturing tolerances on the waveguide housing and on the etching or stamping of the insert place limits on the precision of the filter dimensions, and existing E-plane waveguide filters are unable to provide the precise frequency response needed for narrow bandwidth filters. One solution is to improve the manufacturing process for creating the waveguide housing and the insert in order to improve the precision in the dimensions of the waveguide filter. However this is expensive for the precision needed for narrow bandwidths. Another solution is to fine-tune the filter after manufacture to achieve the desired frequency response from the filter. H-plane filters can be tuned after manufacture, but these are more expensive than E-plane filters due to the more complex assembly required. Furthermore, the tuning of H-plane filters is complex, requiring the adjustment of many tuning screws. There is a need for tuneable E-plane waveguide filters, as these would be less expensive than H-plane filters yet would allow narrower bandwidth filters.

SUMMARY OF THE INVENTION

The present invention provides a waveguide filter comprising an electrically conductive waveguide housing containing a longitudinally extending rectangular channel having spaced sides, the housing being constructed of at least two housing portions assembled together, and at least one electrically conductive relatively thin planar insert extending along and spaced from the sides of the waveguide channel. The upper and lower edges of the insert are sandwiched between two of the housing portions. The insert has at least one cavity located between the upper and lower edges of the insert and situated in the waveguide channel. A recess is provided in the insert, extending from one of the upper and lower edges of the insert into the cavity, and a tuning slider of electrically conductive material is received in the recess and extends into the cavity a distance determined by the desired frequency response of the waveguide filter. The presence of the slider alters the resonant frequency of the cavity, thereby changing the frequency response of the filter. The thickness of each slider and the approximate distance each is to extend into a cavity in the insert is determined analytically. Once inserted, the position of each slider is finely adjusted until the measured frequency response is as desired, and the sliders are then fixed in position.

The recess in a preferred embodiment passes through the entire thickness of the insert to form a gap. It is noted that because the tuning technique is effected by modifying the insert, it is not necessary to modify or alter the housing portions, thus permitting the use of a universal housing for a range of filter designs.

In an alternative embodiment, instead of providing a recess in the insert, a notch is provided in a wall of a housing portion and tuning can be achieved by receiving the slider in the notch. This solution is less preferable because it requires modification of the standard housing.

This construction of waveguide filter allows very precise frequency response curves to be obtained, overcoming the limits imposed by manufacturing tolerances, without the complexity and cost of an H-plane waveguide filter. Furthermore, a particular waveguide filter can later be tuned to a slightly different frequency response by adjusting the sliders.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

The invention will now be described in greater detail with reference to the accompanying diagrams, in which.

DETAILED DESCRIPTION OF THE PREFERRED EMBODIMENTS

Figure 1:
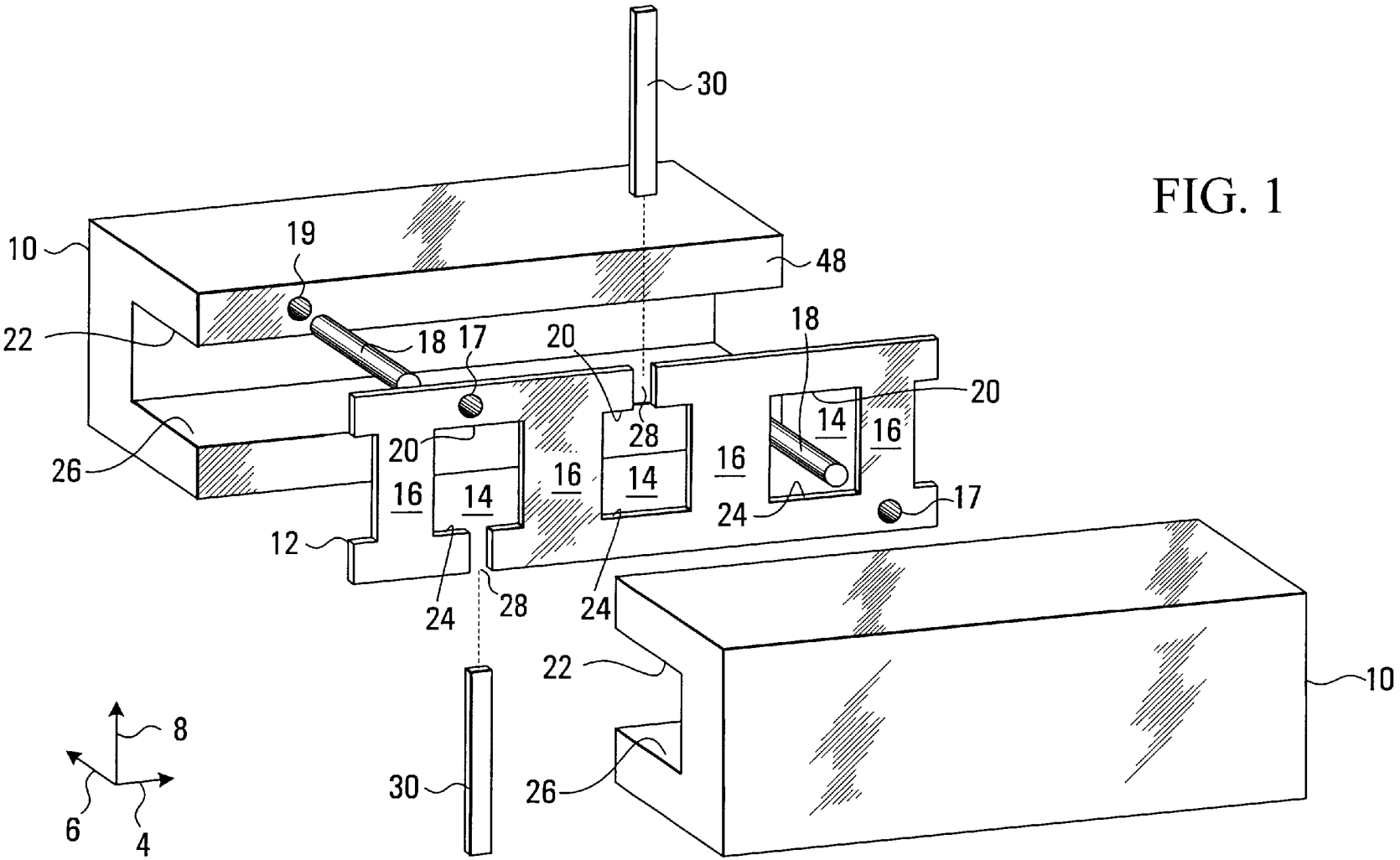
FIG. 1 is an exploded perspective view of an E-plane waveguide filter of the invention.
Figure 3:
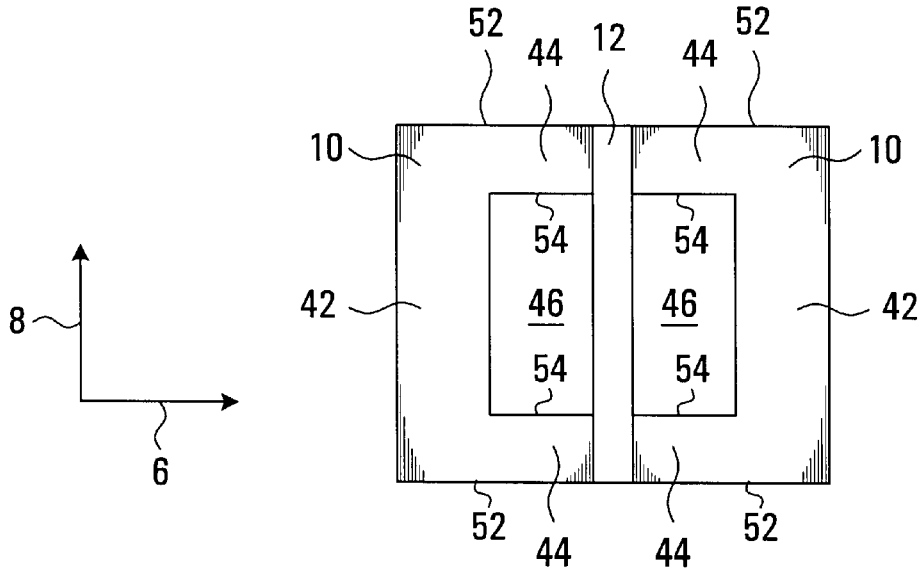
FIG. 3 is an end view of the E-plane waveguide filter of the invention.

FIG. 1 shows the E-plane waveguide filter of the invention. The waveguide housing consists of two halves 10 of a parallelepiped made of an electrically conductive material having a low coefficient of thermal expansion. When assembled, the waveguide will have a longitudinal direction 4 along which an electromagnetic wave is transmitted, a transverse direction 6 lying along the long dimension of a cross-section of the waveguide, and a vertical direction 8 lying along the short dimension of a cross-section of the waveguide. The two halves 10 of the waveguide housing are substantially identical, having a C-shaped cross-section as shown in FIG. 3. Each half 10 is defined by an outer vertical wall 42 and two spaced transverse walls 44. The transverse walls 44 end in mating surfaces 48 (in FIG. 1) adapted to mate with the mating surfaces 48 of the other half 10. However when the waveguide filter is assembled, the mating surfaces 48 of each half 10 will be separated by an insert 12, which is sandwiched between the mating surfaces 48. Two doweling holes 19 are provided and extend transversely through the mating surfaces 48 and part way through the transverse walls 44. The C-shape of the two halves 10 together form a waveguide channel 46.

The insert 12 is formed of a sheet of electrically conductive, easily etched or stamped material, such as copper. The insert 12 is substantially planar and is relatively thin, having two large surfaces, and a transverse dimension, or thickness, significantly less than the longitudinal edges and the vertical edges of the insert 12, and the longitudinal edges being longer than the vertical edges. A number of cavities 14 are etched or stamped into the insert 12 so as to lie between an upper and a lower edge of the insert 12. The cavities 14 are separated by remaining portions of the insert, called fins 16. The number and location of the cavities 14 and fins 16 will depend on the desired frequency response of the filter, and can be determined analytically using well known techniques. The cavities 14 extend the full height of the waveguide channel 46, such that the upper surface 20 of each cavity 14 lies flush with the upper surface 22 of the waveguide channel 46, and the lower surface 24 of each cavity 14 lies flush with the lower surface 26 of the waveguide channel 46.

The insert 12 has gaps 28 above or below one or more of the cavities, into each of which a slider 30 can be inserted along the plane of the insert during assembly. It can be seen that each gap 28 extends from the cavity to the upper (or lower) edge of the insert. The sliders 30 are made of a highly conductive, easily etched or stamped material, such as copper. The thickness of each slider 30 is determined from the desired frequency response of the waveguide filter using well known analytic techniques. Two doweling holes 17 pass transversely through the insert 12. The choice of whether a particular gap 28 will lie in the upper or lower edge of the insert 12 will depend on the positions of the doweling holes 17.

The two doweling holes 17 in the insert 12 are aligned with the doweling holes 19 in the housing halves 10. When assembled, dowels 18 pass from the doweling holes 19 in one half of the housing 10, through the doweling holes 17 in the insert 12, and into the doweling holes 19 of the other half of the housing 10. The insert 12 is held in vertical and longitudinal position by the dowels 18, and is held in transverse position by being sandwiched between the mating surfaces 48 of the two halves of the housing 10. The two halves of the housing 10 are held in position using fasteners (not shown). The fasteners may be, for example, screws passing transversely through the transverse walls 44 and the insert 12, or may be clamps situated outside the waveguide housing 10.

Figure 2:
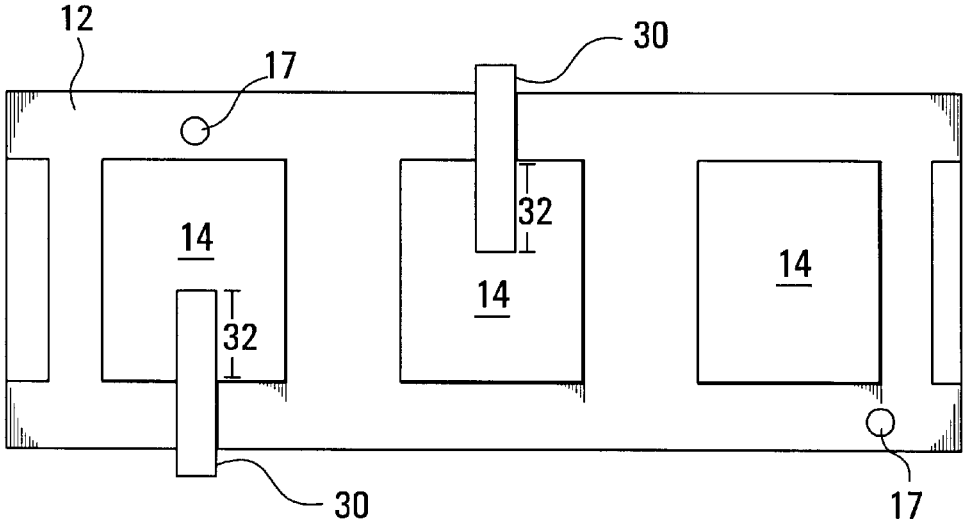
FIG. 2 is a lateral view of the E-plane waveguide filter of the invention with one half of the waveguide housing removed.

FIG. 2 is a transverse view of the waveguide filter when assembled, with one half of the waveguide housing removed to expose details of the filter. The sliders 30 extend into the cavities 14 and alter the resonant frequency of each cavity 14, thereby altering the frequency response of the waveguide filter. The approximate depth 32 that each slider 30 extends into a cavity 14 is determined from the desired frequency response of the waveguide filter using well known analytic techniques. The depth 32 is finely adjusted, either manually or using mechanical means, until the measured frequency response of the waveguide filter matches the desired frequency response. The slider 30 is then fastened in position, using for example glue. If the sliders 30 are thin enough to enter the gap without significant friction against the mating surfaces 48 when the waveguide housing 10 has been fastened together, then the sliders can be inserted, adjusted and fastened in position after the waveguide housing 10 has been fastened. If the sliders are thick enough to encounter significant friction against the mating surfaces 48 when the waveguide housing 10 has been fastened together, then the waveguide housing 10 is not fastened completely until the sliders have been inserted, adjusted and fastened in position.

Figure 4:
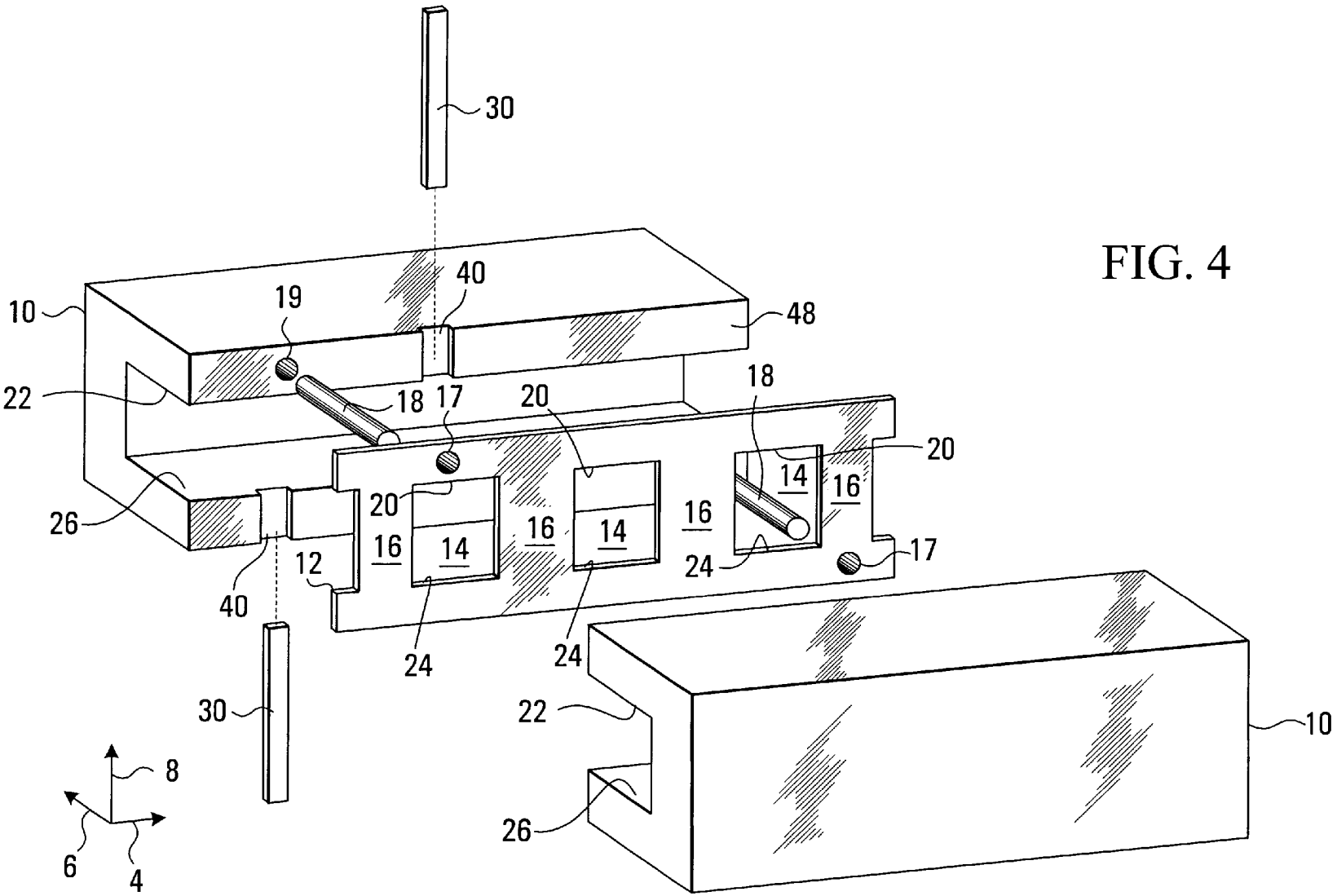
FIG. 4 is an exploded perspective view of an alternate embodiment of the E-plane waveguide filter of the invention.

FIG. 4 shows an alternate embodiment of the E-plane waveguide filter of the invention. In this embodiment there are no gaps in the insert 12. Rather notches 40 are located in one of the halves 10 of the waveguide housing. The notches 40 are recessed into the mating surface 48 of either half 10 of the waveguide housing, and extend from an outer surface 52 of the waveguide housing to an inner surface 54 of the waveguide housing. The choice of whether a particular gap 40 will lie in the upper or lower transverse wall 44 will depend on the positions of the doweling holes 19. When a slider 30 is inserted into a notch 40, the slider 30 lies in a plane parallel to and adjacent to the insert 12. In this embodiment, the method of tuning the filter is the same as in the embodiment shown in FIG. 1. The approximate depth that each slider 30 extends into the waveguide channel 46 is determined from the desired frequency response of the waveguide filter using well known analytic techniques. The depth is finely adjusted until the measured frequency response of the waveguide filter matches the desired frequency response. The slider 30 is then fastened in position, using for example glue. A disadvantage of this embodiment over the first embodiment, however, is that universal housings cannot be used since the location of the notches 40 will depend on the desired frequency response.

In the preferred embodiment of the invention, the walls 42 of the waveguide channel 46 to which the insert 12 is parallel are shorter than the walls 44 of the waveguide channel 46 to which the insert 12 is perpendicular. The converse could be the case, but the filter would then only function for unconventional propagation modes of the electromagnetic signal.

The embodiment shown results in an optimal Q-factor for the filter. Variations resulting in a reduced Q-factor are nevertheless also included in the scope of the invention. The insert 12 could also lie offset from the longitudinal axis of the waveguide housing 10. The cavities 14 need not reach the full height of the waveguide channel 46. The longitudinal dimension, or width, of a slider need not be substantially equal to that of the gaps 28 or notches 40.

Other alternative embodiments are also included within the scope of the invention. The cavities 14 need not be rectangular as shown in the preferred embodiments. The gaps 28 or the notches 40 need not be vertical, but could extend from the upper or lower edge of the insert 12 to the cavity 14 and intersect the cavity 14 at an angle other than 90 degrees. Instead of complete gaps 28 in the insert 12, recesses or notches which do not pass through the entire plane of the insert 12 could be used to receive the respective sliders. However these embodiments may complicate the design of the filter.

A gap may be thought of as a specific form of recess which passes through the insert, and thus the term "recess" is used hereinafter to denote either a recess (notch) which does not pass completely through the insert thickness or a recess (gap) which does pass completely through the insert thickness.

Figure 5:
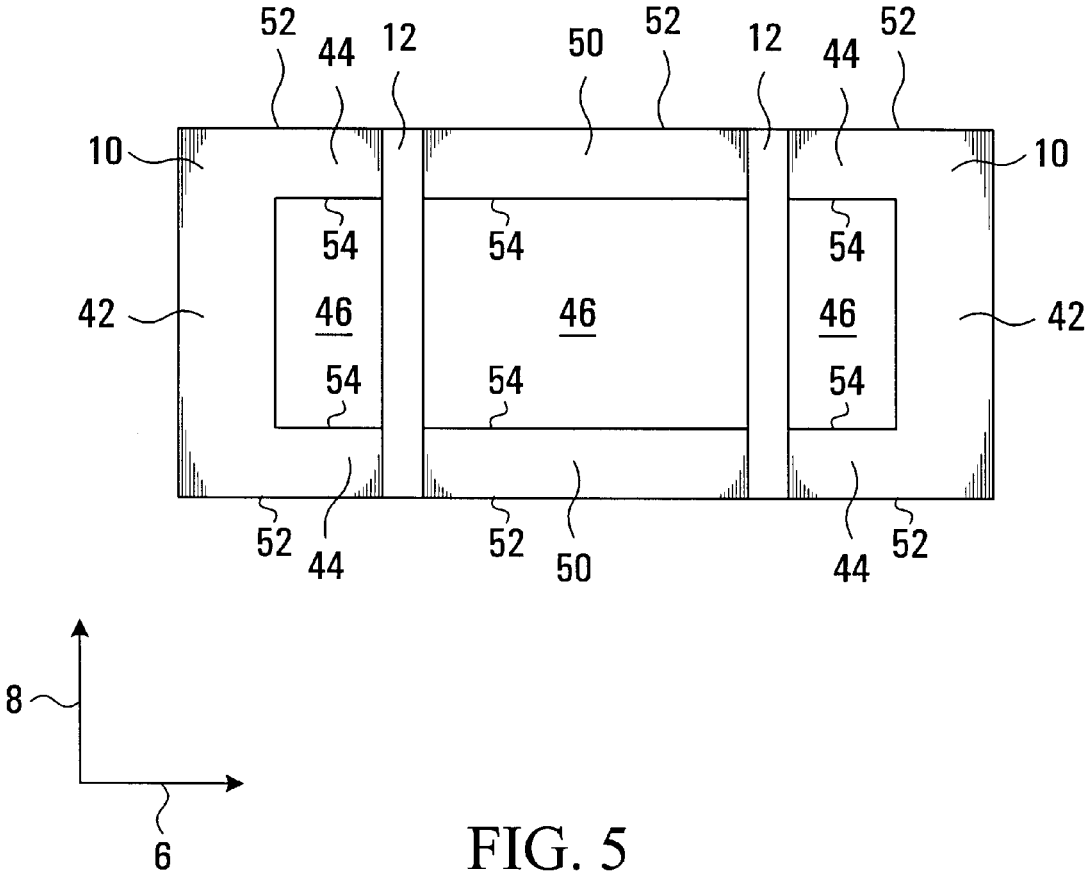
FIG. 5 is an end view of yet another alternate embodiment of the E-plane waveguide filter of the invention.

As a further alternative, more than one insert could be used. In such an embodiment, an end view of which is shown in FIG. 5, the inserts 12 are placed parallel to each other and separated by housing spacers 50 aligned with the transverse walls 44. The housing spacers 50 are held in place by the dowels 18. Sliders 30 can be inserted either through gaps 28 in the inserts 12, as in FIG. 1, through notches 40 in the transverse walls 44, as in FIG. 4, or through notches in the housing spacers 50.

As yet a further alternative, the dowels 18 can be replaced by pins projecting contiguously from one of the housing halves 10 rather than being separate pieces inserted into doweling holes in both halves of the housing.

The outer form of the waveguide housing need not be exactly as depicted. In particular, flanges or flange holes could be provided at the longitudinal ends of the housing to allow the waveguide filter to be fastened to other components in a communication path.

What has been described is merely illustrative of the application of the principles of the invention. Other arrangements and methods can be implemented by those skilled in the art without departing from the spirit and scope of the present invention. For example, other methods of fastening the housing and the insert can be implemented, as long as they do not interfere in the placement of the sliders.

We claim:

1. A waveguide filter comprising:

an electrically conductive waveguide housing containing a longitudinally extending rectangular channel having spaced sides, the housing being constructed of at least two housing portions assembled together;

at least one electrically conductive relatively thin planar insert extending along and spaced from the sides of the waveguide channel and having upper and lower edges sandwiched between two of the housing portions, the insert having at least one cavity located between the upper and lower edges and being situated in the waveguide channel;

wherein a recess is provided in the insert, the recess extending from one of the upper and lower edges of the insert into the cavity, and a tuning slider of electrically conductive material is received in the recess and extends into the cavity a distance determined by the desired frequency response of the waveguide filter.

2. The waveguide filter of claim 1 wherein the cavity is rectangular.

3. The waveguide filter of claim 1 wherein there are a plurality of cavities and a plurality of respective recesses.

4. The waveguide filter of claim 1 wherein the insert is substantially parallel to the sides of the waveguide channel.

5. The waveguide filter of claim 1 wherein the tuning slider has a thickness substantially the same as that of the recess.

6. The waveguide filter of claim 1 wherein the tuning slider is substantially the same width as the recess.

7. The waveguide filter of claim 1 wherein the recess passes through the entire thickness of the insert to form a gap.

8. The waveguide filter of claim 1 wherein the recess does not pass through the entire thickness of the insert.

9. The waveguide filter of claim 1 wherein there is one insert.

10. The waveguide filter of claim 9 wherein there are two substantially identical housing portions.

11. The waveguide filter of claim 10 wherein the insert is substantially parallel to the sides of the waveguide channel.

12. The waveguide filter of claim 9 wherein the insert is substantially parallel to the sides of the waveguide channel.

13. The waveguide filter of claim 1 wherein there are a plurality of inserts, two outer housing portions, and a plurality of inner housing portions.

14. The waveguide filter of claim 13 wherein the outer housing portions are substantially identical.

15. The waveguide filter of claim 14 wherein the insert is substantially parallel to the sides of the waveguide channel.

16. The waveguide filter of claim 13 wherein the insert is substantially parallel to the sides of the waveguide channel.

17. A method of assembling a waveguide filter constructed according to claim 1 comprising:

sandwiching the insert between the two housing portions;

inserting the tuning slider through the recess to project into the cavity;

measuring an actual frequency response of the waveguide filter;

adjusting the distance which the tuning slider extends into the cavity until the actual frequency response equals the desired frequency response; and fixing the tuning slider in position.

18. A waveguide filter comprising:

an electrically conductive waveguide housing containing a longitudinally extending rectangular channel having spaced sides, the housing being constructed of at least two housing portions assembled together, each housing portion having an inner surface adjacent to the channel, an outer surface, and a mating surface;

at least one relatively thin electrically conductive planar insert extending along and spaced from the sides of the waveguide channel and having upper and lower edges sandwiched between the mating surfaces of two of the housing portions, the insert having at least one cavity located between the upper and lower edges and being situated in the waveguide channel;

wherein a notch is provided in one of the housing portions, the notch extending from the outer surface to the inner surface along the mating surface, and a tuning slider of electrically conductive material is received in the notch and extends into the waveguide channel adjacent to the cavity a distance determined by the desired frequency response of the waveguide filter.

19. The waveguide filter of claim 18 wherein there are a plurality of cavities and a plurality of respective notches.

20. The waveguide filter of claim 18 wherein the insert is substantially parallel to the sides of the waveguide channel.

21. The waveguide filter of claim 18 wherein the tuning slider has a thickness substantially the same as the depth of the notch.

22. The waveguide filter of claim 18 wherein the tuning slider is substantially the same width as the notch.

23. The waveguide filter of claim 18 wherein there is one insert.

24. The waveguide filter of claim 23 wherein there are two substantially identical housing portions.

25. The waveguide filter of claim 24 wherein the insert is substantially parallel to the sides of the waveguide channel.

26. The waveguide filter of claim 23 wherein the insert is substantially parallel to the sides of the waveguide channel.

27. The waveguide filter of claim 18 wherein there are a plurality of inserts, two outer housing portions, and a plurality of inner housing portions.

28. The waveguide filter of claim 27 wherein the outer housing portions are substantially identical.

29. The waveguide filter of claim 28 wherein the insert is substantially parallel to the sides of the waveguide channel.

30. The waveguide filter of claim 27 wherein the insert is substantially parallel to the sides of the waveguide channel.

31. The waveguide filter of claim 18 wherein the cavity is rectangular.

32. A method of assembling a waveguide filter constructed according to claim 18 comprising:

sandwiching the insert between the two housing portions;

inserting the tuning slider through the notch to project into the cavity;

measuring an actual frequency response of the waveguide filter;

adjusting the distance which the tuning slider extends into the cavity until the actual frequency response equals the desired frequency response; and fixing the tuning slider in position.

33. An electrically conductive waveguide housing adapted to be used with at least one relatively thin electrically conductive planar insert to form a waveguide filter, the housing containing a longitudinally extending rectangular channel having spaced sides and being constructed of at least two housing portions assembled together, each housing portion having an inner surface adjacent to the channel, an outer surface and a mating surface, wherein:

at least one notch is provided in one of the housing portions, the notch extending from the outer surface to the inner surface along the mating surface and being adapted to receive a tuning slider which co-operates with the insert.

* * * * *